US005720273A

United States Patent [19]

Trullas

[11] Patent Number: 5,720,273

[45] Date of Patent: Feb. 24, 1998

[54] OVEN WITH SUPPORT FOR COOKING VESSELS

[75] Inventor: Francesc Seuba Trullas, Igualada, Spain

[73] Assignee: Positron Investimentos E Servicos Loa., Madiera, Portugal

[21] Appl. No.: 744,084

[22] Filed: Nov. 5, 1996

[30] Foreign Application Priority Data

Nov. 7, 1995 [ES] Spain ..... 9502824

[51] Int. Cl.[6] ..... A21B 1/52

[52] U.S. Cl. ..... 126/275 E; 126/275 R; 126/19 R; 126/337 R

[58] Field of Search ..... 126/281, 343.5 R, 126/1 R, 39 N, 348, 377, 266, 268, 33, 21 R, 275 E, 275 R, 19 R, 21 A, 337 R, 369.2, 363

[56] References Cited

U.S. PATENT DOCUMENTS

| | | | |
|---|---|---|---|
| 2,683,795 | 7/1954 | Sheidler et al. | 126/275 E |
| 3,548,153 | 12/1970 | Kells | 126/21 A X |
| 3,820,524 | 6/1974 | Buckell | 126/21 A X |

*Primary Examiner*—Larry Jones

*Attorney, Agent, or Firm*—Steinberg, Raskin & Davidson, P.C.

[57] ABSTRACT

An oven for receiving and heating cooking vessels including a plurality of heating units for generating heat and which are arranged in different horizontal planes. A respective cooking vessel is positionable in association with each heating unit. The oven may include a support structure such as connected rods for supporting the cooking vessels in association with the respective heating unit.

15 Claims, 1 Drawing Sheet

OVEN WITH SUPPORT FOR COOKING VESSELS

FIELD OF THE INVENTION

The present invention relates to an oven of the type which includes a plurality of heating units, each one of which is used for a single cooking vessel.

BACKGROUND OF THE INVENTION

Domestic ovens for cooking or heating food usually comprise a single heating unit, usually a resistor element, which permits a single dish to be cooked at any one time in the oven.

For use in a restaurant, however, ovens have to be designed for cooking or heating several dishes simultaneously. These ovens usually comprise a plurality of heating units, generally arranged in a substantially horizontal plane, with one cooking vessel being placed on each of the heating units.

One particular disadvantage of this type of ovens, specially designed for restaurants, is that they occupy too much space.

Another problem common to all types of ovens, but particularly serious in ovens of large size, is that the heat is concentrated excessively at the rear part thereof. This concentration of heat results in that the dish in the cooking vessel placed into the oven is not cooked uniformly, and the rear part of the oven can even burn.

OBJECTS AND SUMMARY OF THE INVENTION

It is an object of the present invention to provide a new and improved oven which solves the aforesaid drawbacks of prior art ovens, while presenting other advantages which will be discussed below.

In order to achieve this object and others, the oven in accordance with the invention includes heating units situated in as many horizontal planes as desired. As a result of the presence and use of a plurality of horizontal planes, since the heating units are placed one over the other, the space occupied by the oven in a horizontal direction is minimal. Advantageously, the oven of the invention includes support means for each of the cooking vessels, in order to prevent the cooking vessels from being in direct contact with the heating units. Preferably, the support means comprise a pair of rods situated close to the inner side walls of the oven, whereby the cooking vessel rests on these rods.

In one specific embodiment, the oven of the invention includes a protecting plate placed beneath the rear part of at least one and preferably each one of the heating units in order to prevent concentration of heat on the cooking vessel which is placed underneath each one of them. The edible dish in the cooking vessel will thus be cooked uniformly. Preferably, the protecting plate is attached to the support means by suitable attachment means.

In its most basic embodiment, the oven for receiving and heating cooking vessels in accordance with the invention comprises a plurality of resistor elements or heating units for generating heat arranged in different horizontal planes whereby a respective cooking vessel is positionable in association with each heating unit. Support means for supporting the cooking vessels in association with the respective heating unit may be included and may constitute a spaced pair of rods placed proximate a respective inner side wall of the oven such that a cooking vessel rests on each pair of rods. An elongate transverse rod can connect the pair of rods. Protecting means, such as a plate, can be arranged beneath a rear part of at least one heating unit for protecting the cooking vessel positioned beneath that heating unit from a concentration of heat thereon.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
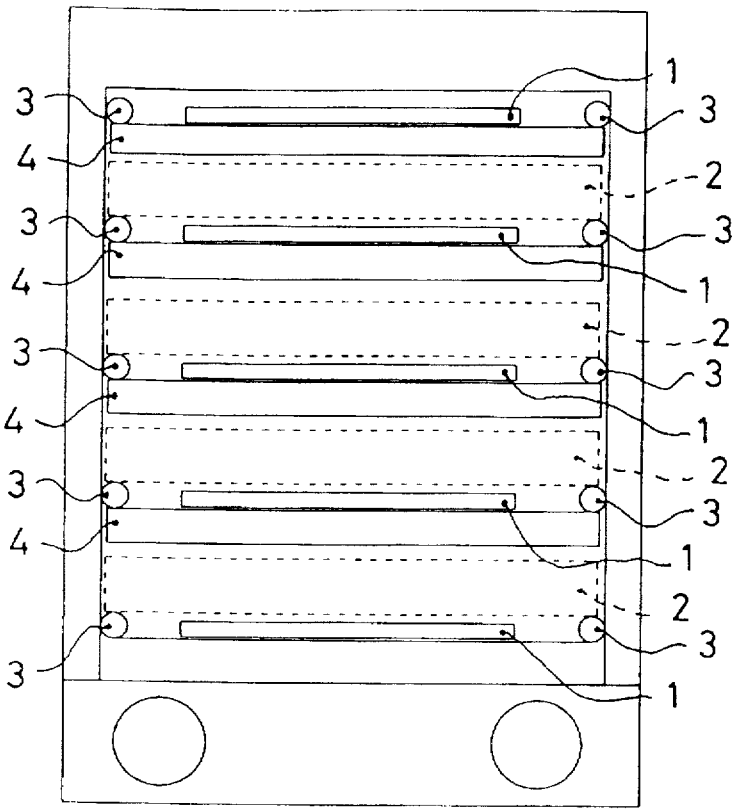
FIG. 1 is a front view of an oven in accordance with the invention.

Referring to the accompanying drawings wherein the same reference numerals refer to the same or similar elements, as shown in FIG. 1, the oven according to the invention includes a plurality of resistor elements 1 (or other equivalent heating members or units) situated one above the other in as many horizontal planes as desired or required, e.g., depending on space considerations. A cooking vessel 2, shown in dotted lines, is placed above each of the resistor elements 1 so that the food dish in the cooking vessel is heated thereby. As shown, the resistor elements are arranged vertically one above another.

In order to prevent the cooking vessel 2 from coming into contact with the resistor element 1, the oven of the invention includes a pair of rods 3 situated dose to the inner side walls of the oven. As shown in FIG. 1, the cooking vessel rests on the rods 3. The rods 3 may be elongate and substantially cylindrical as shown and extend substantially parallel to one another on two opposed sides of the oven.

The oven of the invention also includes a heat-protection means such as a protecting plate 4 situated beneath the rear part of each one of the resistor elements 1 in order to prevent the concentration of heat on the cooking vessel 1 which is situated under each of them. Protecting plate 4 may extend across the width of the oven between the rods and possibly even at least partially under the rods 3 to facilitate attachment of the protecting plate 4 to the rods 3.

Figure 2:
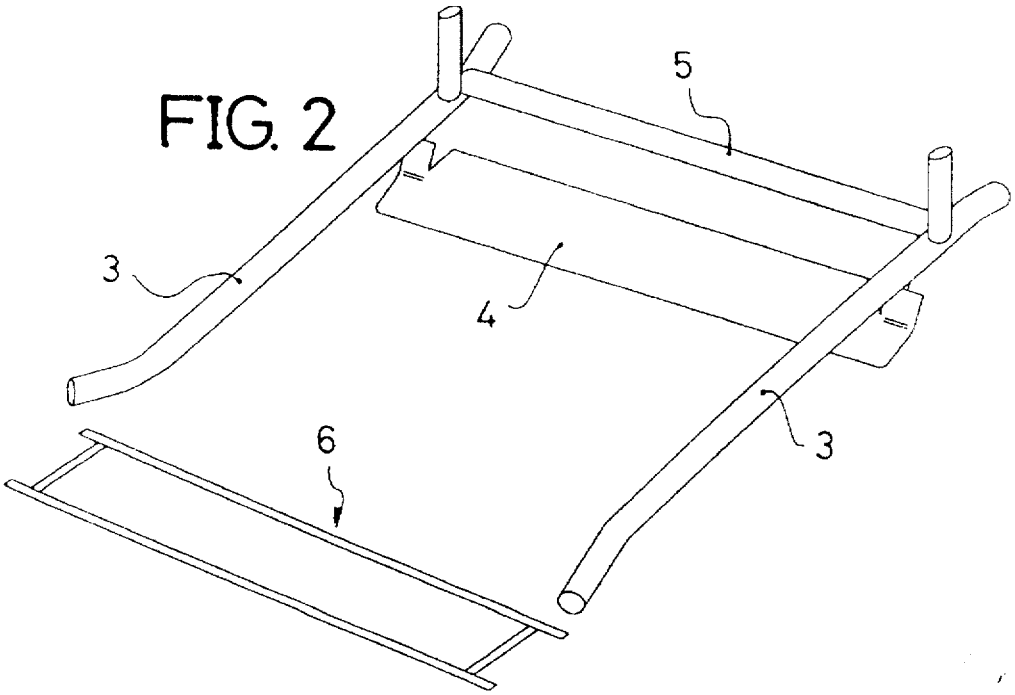
FIG. 2 is a perspective view of the support means with a protecting plate attached thereto for use in the oven in accordance with the invention.

As shown in FIG. 2, the protecting plate 4 is attached to the rods 3, which are in turn attached to each other by means of an elongate transverse rod 5. The unit formed by the rods 3 and the protecting plate 4 is placed in such a way that the rod 5 rests on the rear part of the corresponding resistor element 1, with the protecting plate 4 being placed under it, i.e., the resistor element 1 is situated between the protecting plate 4 and the transverse rod 5. The front part of the rods 3 rests on a supporting member 6, which is fixed to the inner side walls of the oven thereby supporting the entire structure of rods 3, 5 and protecting plate 4.

Independent of the object of the invention are the materials used for manufacturing the components of the oven, the shapes and dimensions thereof and all accessory details which might arise, as long as they do not affect its essential nature.

The examples provided above are not meant to be exclusive. Many other variations of the present invention would be obvious to those skilled in the art, and are contemplated to be within the scope of the appended claims.

I claim:

1. An oven for receiving and heating cooking vessels, comprising a plurality of heating units for generating heat, said heating units being arranged in different horizontal planes, a respective one of said cooking vessels being positionable in association with each of said heating units, said heating units having a front part proximate a front of the oven and a rear part proximate a rear of the oven, and protecting means arranged beneath only said rear part of at least one of said heating units for protecting one of said cooking vessels positioned beneath said at least one of said heating units from a concentration of heat at a portion of said one of said cooking vessels proximate the rear of the oven, said protecting means not extending beneath said front part of said at least one heating unit.

2. The oven of claim 1, further comprising support means for supporting said cooking vessels in association with the respective one of said heating units.

3. The oven of claim 2, wherein said support means each comprise a pair of rods placed proximate inner side walls of the oven, one of said cooking vessels resting on each of said pairs of rods.

4. The oven of claim 3, wherein said support means further comprise an elongate transverse rod attached to each of said pairs of rods.

5. The oven of claim 3, wherein said support means further comprise a supporting member for coupling said pair of rods to an inner wall of the oven.

6. The oven of claim 1, wherein said protecting means comprise a plate.

7. The oven of claim 6, wherein said plate extends from one side of the oven to the opposed side of the oven across only the rear of the oven and not the front of the oven.

8. The oven of claim 1, further comprising support means for supporting said cooking vessels in association with the respective one of said heating units, said protecting means being attached to said support means.

9. The oven of claim 8, wherein said support means each comprise a pair of rods placed proximate opposed inner walls of the oven, one of said cooking vessels resting on each of said pairs of rods, said protecting means comprising a protecting plate attached to each of said pairs of rods supporting said at least one of said heating units.

10. The oven of claim 9, wherein said support means further comprise an elongate transverse rod attached to each of said pairs of rods.

11. The oven of claim 9, wherein said support means further comprise a supporting member for coupling said pair of rods to an inner wall of the oven.

12. The oven of claim 1, wherein said heating units are arranged vertically one above another.

13. The oven of claim 1, wherein said protecting means are arranged beneath only said rear part of all of said heating units for protecting one of said cooking vessels positioned beneath said heating units from a concentration of heat on a portion of a respective one of said cooking vessels proximate the rear of the oven.

14. The oven of claim 13, wherein each of said protecting means are spaced from a respective one of said heating units situated above said protecting means.

15. The oven of claim 1, wherein said protecting means are spaced from said at least one of said heating units.

* * * * *

UNITED STATES PATENT AND TRADEMARK OFFICE

CERTIFICATE OF CORRECTION

PATENT NO. : 5,720,273

DATED : February 24, 1998

INVENTOR(S) : Francesc Seuba Trullas

It is certified that error appears in the above-identified patent and that said Letters Patent is hereby corrected as shown below:

Assignee:

On the title page, item [73], delete "Loa., Madiera" and insert --Lda., Madeira--.

Signed and Sealed this

Second Day of June, 1998

*Attest:*

*Attesting Officer*

Bruce Lehman

BRUCE LEHMAN

*Commissioner of Patents and Trademarks*